United States Patent [19]

Plegge et al.

[11] Patent Number: 5,055,070

[45] Date of Patent: Oct. 8, 1991

[54] OVERMOLDED SHIELDED CONNECTOR

[75] Inventors: Richard W. Plegge, Palatine; Charles T. Walsh, Elgin; Rocco J. Peters, Lincolnwood; Gregory J. Sellers, Naperville, all of Ill.

[73] Assignee: Labinal Components and Systems, Inc., Elk Grove Village, Ill.

[21] Appl. No.: 574,458

[22] Filed: Aug. 29, 1990

[51] Int. Cl.[5] ..... H01R 13/648

[52] U.S. Cl. ..... 439/609; 439/610; 439/904

[58] Field of Search ..... 439/607, 609, 610, 585, 439/901, 904, 906

[56] References Cited

U.S. PATENT DOCUMENTS

| | | | |
|---|---|---|---|
| 4,585,292 | 4/1986 | Frantz et al. | 439/610 |
| 4,592,612 | 6/1986 | Kikuta | 439/610 |
| 4,689,723 | 8/1987 | Myers et al. | 439/607 X |

*Primary Examiner*—Larry I. Schwartz
*Assistant Examiner*—Julie R. Daulton
*Attorney, Agent, or Firm*—Neuman, Williams, Anderson & Olson

[57] ABSTRACT

The shield covers of an overmold shielded electrical connector have pivot detents stamped into their surfaces to provide a point for the shield halves to rotate on the center dielectric with a lever type action. When fully closed, the lever action assures that the cover tabs of the shield members securely contact the connector shell and maintain a positive ground.

32 Claims, 6 Drawing Sheets

OVERMOLDED SHIELDED CONNECTOR

BACKGROUND OF THE INVENTION

This invention relates to electromagnetically shielded connectors which can be overmolded with an insulative layer and more particularly to the shields for use in combination with a standard connector to achieve a connecting system having electromagnetic compatibility and provide a positive solderless ground for the shield.

Shielded electrical connectors are necessary in the telecommunications and computer industry to provide a means for shielding electrical connections from external electromagnetic signals and to prevent the systems which use the connections from emitting electromagnetic signals. The connectors provide a means for continuing the shielding of a shielded cable either to another shielded cable or to an electronic device.

The use and transmission of high frequency electrical signals necessitates the need for shielded electrical connections. High frequency electromagnetic signals are susceptible to interference from other undesirable electromagnetic signals. In addition, these signals also naturally generate unwanted electromagnetic signals of their own which may interfere with other electronic devices. Electromagnetic shielding is generally required to satisfy United States Federal Communication Commission standards which place limits on the emission of interfering electromagnetic signals. The use of a grounded continuous metal shield which surrounds the electrical wiring, cable or electronic device is the most effective way to minimize these undesirable effects and satisfy the standards. Furthermore, shielded electrical connectors are necessary to maintain the integrity of a shielded system from one device to another device.

Electrical connectors are known in the art and generally comprise an insulative or dielectric housing which contains a plurality of terminals in a like plurality of terminal passages. In addition, a pair of metal shell members are affixed to the insulative housing to form a peripheral mounting flange on the insulative housing.

The present invention includes a pair of mating metal shield members each of which has a forward end engageable with the metal shell members of the connector. The shield members also have interengaging integral side walls which define an annular cable exit and cavity. Additionally, pivot means are provided for each shield half to rotate on the dielectric and assure a positive pressure ground connection between the forward end of the shield halves and the metal shell of the connector.

SUMMARY OF THE INVENTION

The present invention is an overmolded shielded electrical connector which maintains a positive electrical connection between the overmold shield covers and the connector shell. The shielded electrical connector consists of an electrical connector, first and second metal shells and a pair of metal shields. The connector has an insulative housing with a plurality of terminal passages which contain pin or socket contacts. The front shell has an integral metallic shroud which encloses the forward end of the insulative housing. The rear shell also defines a cavity which receives the rear portion of the insulative housing and has a flange with recesses along the rear edge of the shell. The shield members have a generally planar primary wall with integral side walls. The forward edge of each shield member has engagement lip means designed to engage beneath an edge or lip of the rear shell. The rear of the shield terminates in a cable exit passage configuration.

Fulcrum means are provided to serve as pivots for the shield members to rotate on the dielectric housing with a lever type action as these members are mated. When the shield members are fully closed, the lever action assures that the lips of the shield halves securely contact overlying portions of the connector shell and provide a positive electrical connection.

In a preferred embodiment pivot detents are formed in the shield members and rest on the center dielectric housing to establish a fulcrum for these shield members which thereby act as simple levers. When the shield members are rotated into their seated positions, slightly before the shield members reach a fully closed position the pivot detents engage the center dielectric housing in resilient interference such that a small force must be applied on the rear of the shield members to overcome the interference. When this force is applied, the forward edge and lips of the shield members securely engage overlying portions of the connector shell. Once the shield members are fully seated and mated, the loaded condition of the simple lever action assures the electrical continuity between the shield members and the connector shell. For ease of manufacturing, the shield members may be complementary mateable halves and may be held closed by a set of complementary interlocking detents and protuberances to form the shield cover.

Accordingly, it is an object of this invention to provide an improved shielded electrical connector.

It is another object of this invention to provide overmolded shielded electrical connectors with a solderless positive electrical connection which is achieved by pivoting the shield members on the dielectric housing and into forceful engagement with a shell of the connector in the course of assembly.

It is a further object to provide an improved interlocking shield assembly on electrical connectors which biases the dielectric, the connector shells and the shield member into fixed predetermined relationships between one another.

It is a specific object of this invention to achieve the solderless positive electrical connection by placing pivot detents on the surfaces of mating shield members so that the cover members rotate on the dielectric housing with a lever type action as the cover members are moved to their assembled positions.

Other objects, advantages and features of the present invention will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings, and described below by way of examples of the invention. In the drawings.

It should be understood that the drawings are not necessarily to scale and that an embodiment is sometimes illustrated in part by schematic and fragmentary views. In certain instances, details of the actual structure which are not necessary for an understanding of the present invention may have been omitted. It should be understood, of course, that the invention is not necessarily limited to the particular embodiments illustrated herein.

DESCRIPTION OF THE ILLUSTRATED EMBODIMENTS

Figure 3:
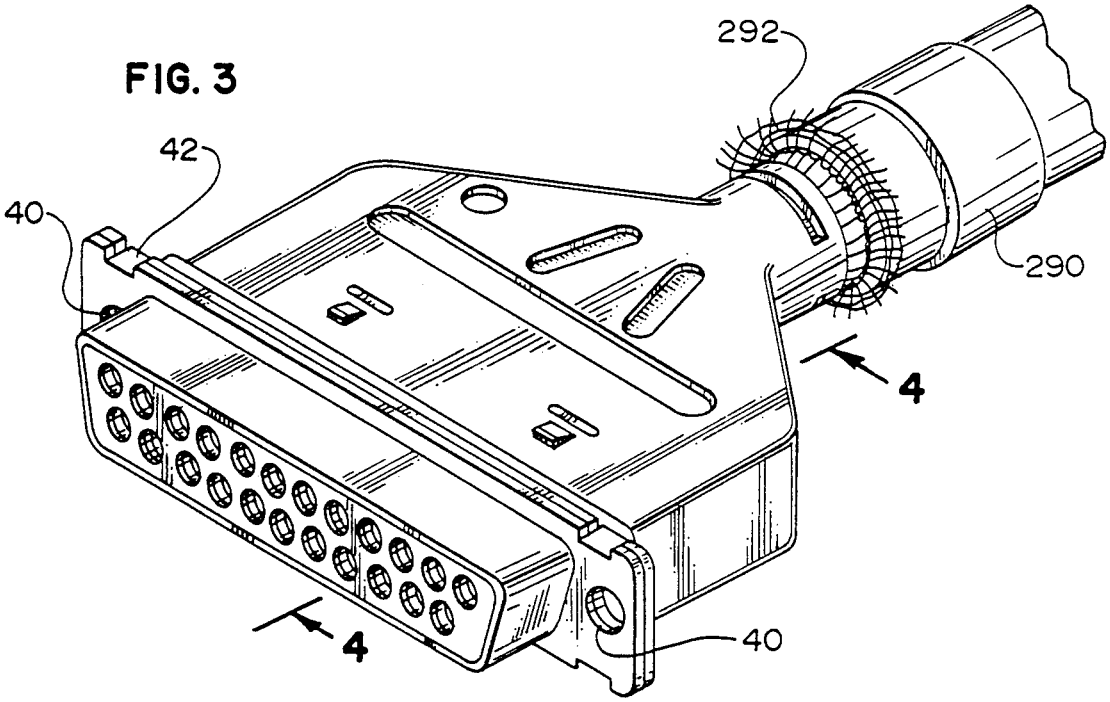
FIG. 3 is an illustration of an assembled connector.
Figure 4:
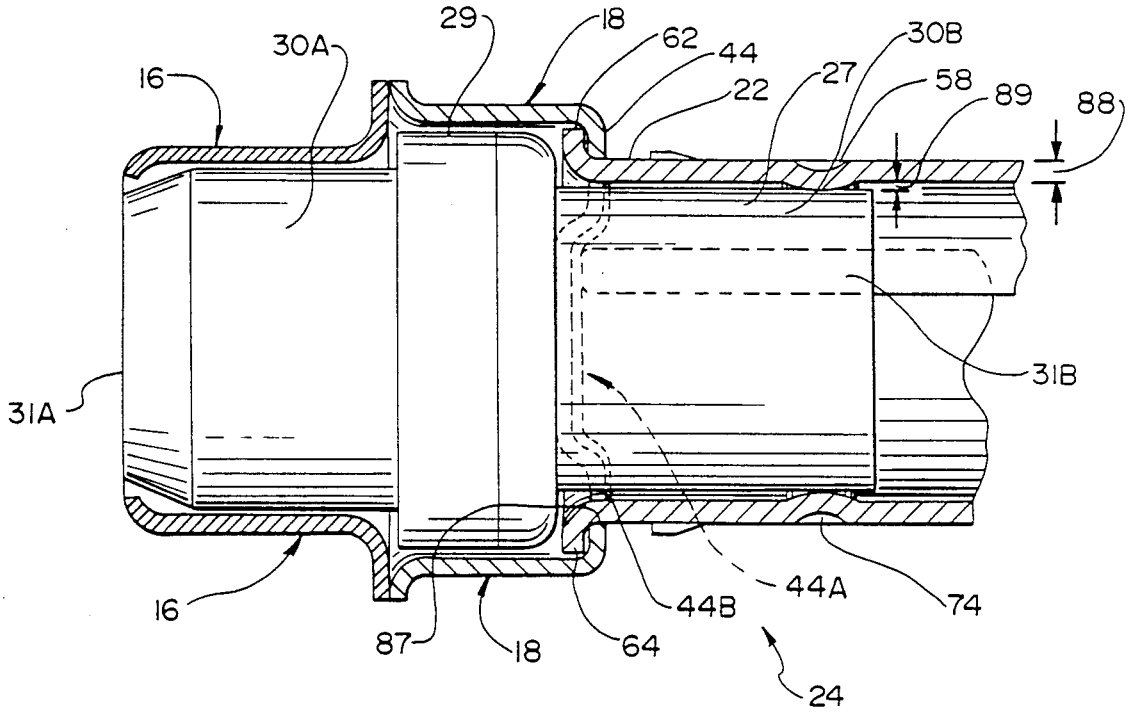
FIG. 4 is a partially schematic sectional view of the shielded electrical connector taken along line 4—4 of FIG. 3.

Referring to FIGS. 1-4, an overmolded shielded electrical connector is indicated generally by the reference numeral 10. The shielded electrical connector 10 consists of an electrical connector 14, first and second metal shells 16, 18 and a metal shield formed by a pair of metal shield members 22, 24. As shown in FIG. 4, the connector 14 has an insulative or dielectric housing 27 with an integral peripheral flange 29 and a front mating portion 30A presenting a front face 31A and a rear or tail portion 30B presenting a rear face 31B with a plurality of terminal passages 32 therethrough. Each passage 32 has a suitable pin socket contact 33 mounted therein, used to terminate the respective conductors of cable 38. (See FIG. 2) The only differences between the illustrated female connector version of the present invention and a male version are that the conductors of cable 38 would terminate to pin contacts rather than socket contacts and the contacts would include pins protruding from front face 31 for mating with the socket contacts and a surrounding front shell portion for sliding over and contacting the front shell 16 in a conventional manner.

The metal shells 16 and 18 are each integral stamped and formed metal members. The front shell 16 has mounting apertures 40 and gripping lugs 42 and is received against the front surface of flange 29. The front shell 16 has an integral metallic shroud enclosing the forward end of the housing 27. The metallic shroud provides a continuation of the metal shell shielding and conductive contact from one connector to another when two connectors are mated as noted above. The rear shell 18 has matching apertures 43 which align with apertures 40 of front shell 16 and recesses which receive lugs 42 to secure the front and rear shells together. The rear shell 18 also defines a cavity which receives the flange portion 29 of the housing 27 and has a flange 44 with an opening 44A through which the tail portion 30B is received. The inner edge of the flange opening provides access spaces or slots 44B along the outer wall of tail portion 30B and is formed with a plurality of inwardly opening edge recesses 45. The connector portion 14 is assembled in the usual manner by combining shells 16 and 18 and connecting terminals to their respective wires from the cable 38.

The shield members 22 and 24 are complementary to one another and will be referred to herein as top and bottom members solely for convenience. The top shield member or cover 22 is an integral stamped and formed metal member having a generally planar wall 46 with side walls 48 and 50. These side walls extend along the forward as well as the end portions and the angled portion of the connector, see, e.g., the complementary walls of the lower connector shown in FIG. 1. The planar wall 46 has a transverse embossment 52 and diverging embossments 54 and 56 with stamped inwardly protruding fulcrum detents 58 and 60. The forward edge of each shield member has engagement lips 62 while the rear of the shield terminates in a semicircular cable exit portion 66.

Additionally, the shield member 22 may contain at least one pressure relief means 68 and at least one overmold grip means 72. In this embodiment, the pressure relief means 68 is a hole or aperture in the shield. Furthermore, the angled portions of the side walls have latching apertures (not shown). In this particular embodiment, the latching apertures are square in configuration. The latching apertures will engage latching lugs on the bottom shield member to hold the shield halves together after the shields are assembled, in a known manner.

The overmold grip means 72 are located on the planar wall 46 near the engagement lips 62. The grip means 72 are upwardly protruding embossments which are formed so that a majority of their peripheral surface is free from the adjacent wall 46 except for the connecting or hinge portion of the grip means 72. The purpose of the grip means 72 is to allow a small amount of overmold material to flow into the shield cavity. After the overmold material has hardened, the grip means will prevent the overmold material from being pulled away from the shield members.

The bottom shield member 24 is similar to shield 22 and includes the inwardly protruding stamped pivot detents 74 and 76, a pressure relief means 78, a first transverse embossment 79, and a second embossment 80 located on planar surface 82. Latching lugs 84 are located on side walls 86. The latching lugs 84 are formed so that they protrude outwards away from the side wall of the shield. In another embodiment, the latching lugs are formed so that a majority of their peripheral surface is free from the adjacent side wall except for the connecting or hinge portion of the latching lug.

Figure 1:
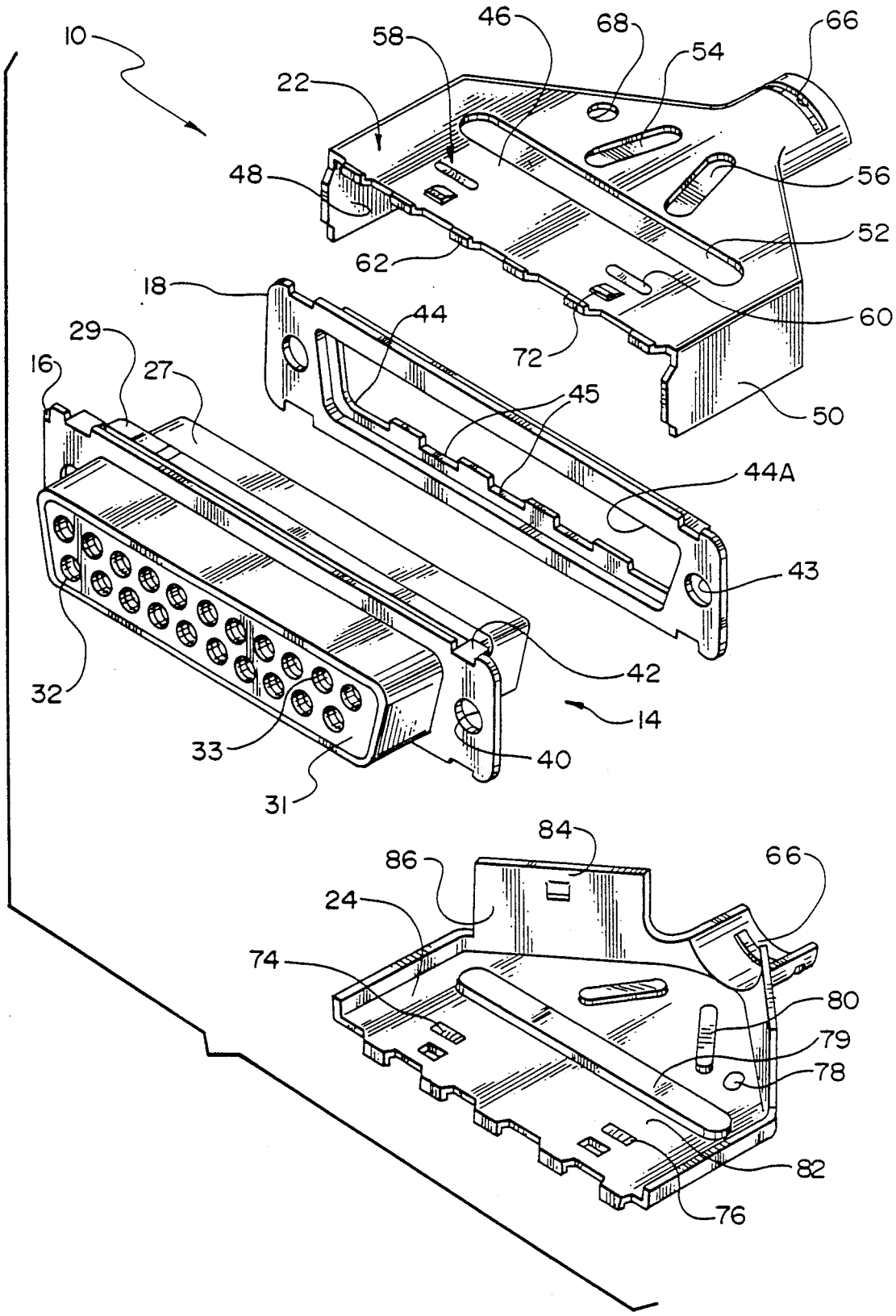
FIG. 1 is an exploded perspective view of one embodiment of a shielded connector assembly employing the invention showing two mateable cover halves.
Figure 2:
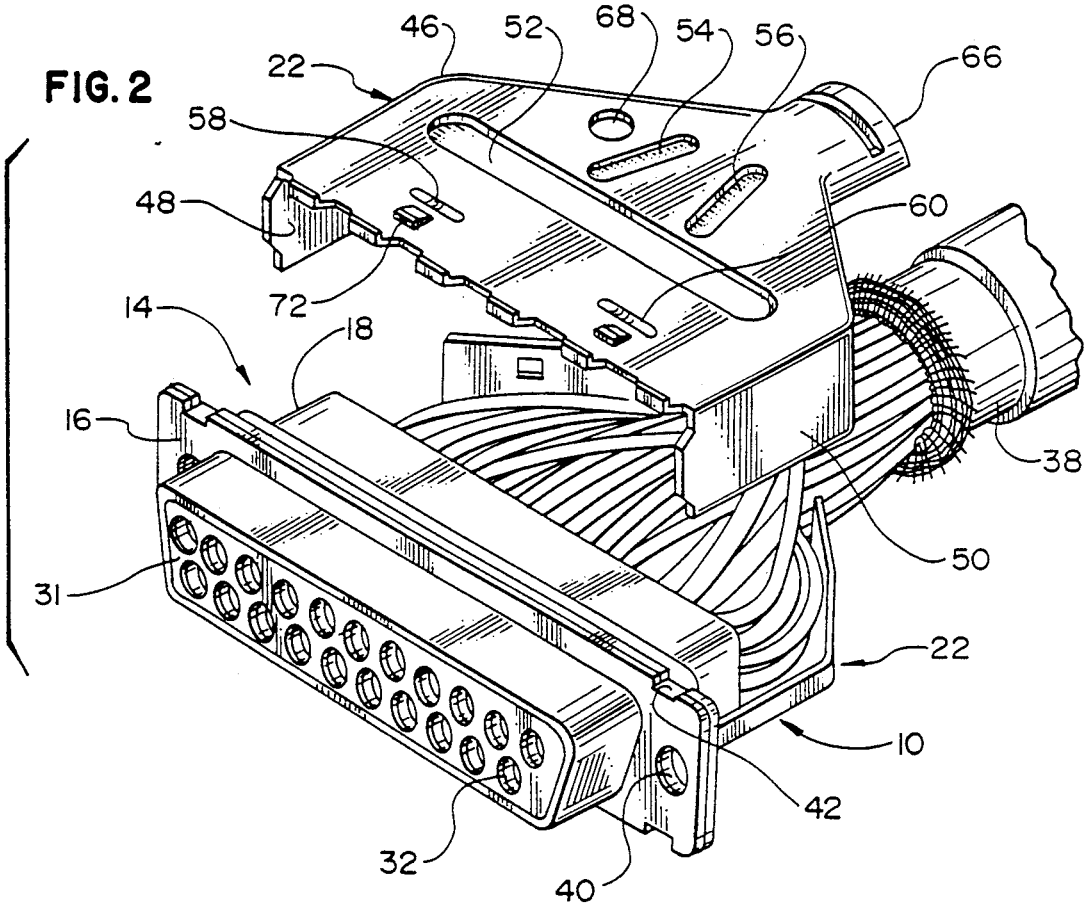
FIG. 2 is a view similar to FIG. 1 showing the subject connector in a partially assembled condition with only one shield member exploded therefrom.

The operation of the shields 22 and 24 will be discussed by describing the operation of shield 22 since both shields operate in a similar manner. Referring to FIGS. 1 and 4, the lips 62 of the shield 22 are extended through the slot space within opening 44A, between the inner edge of the flange 44 and the tail portion of the dielectric housing 30B. In particular, the sectioned lips or tines may be hooked into the recesses 45 of the rear shell 18. This initial insertion typically occurs with the shield member tilted outward relative to the adjacent surface of tail portion 30B and the cable 38 to facilitate the insertion.

Thereafter, the shield member is rotated inward, towards the cable 38, until the pivot detents 58 and 60 contact the dielectric housing 27. Further inward movement of the outer or distal end portion of the shield member results in pivotal movement of the shield about the fulcrum established by the engagement of the detents with the dielectric housing. Thereby, the further inward movement of the distal end portion causes concomitant outward movement of the lip portions beneath the edge of opening 44A.

The relevant dimensions, including the height of the insertion space, the effective thickness of the shield metal and the height of the protruding fulcrum detents is such that the pivot detents cause the tines 62 of the shield 22 to contact the shell 18 and oppose further downward rotation of the shield 22, preferably before the shield member reaches its fully seated or closed position of FIG. 3.

One particular embodiment of this invention has the following dimensions: the height of each insertion space 44B, i.e., the distance between tail portion of the dielectric housing 30B and the inwardly facing surface 87 of recess 45 is at least 0.030 inches; the thickness 88 of the shield members 22,24 is 0.020 inches and the height 89 of the fulcrum detents 58,74 is at least 0.010 inches.

The forward edge and cover tabs of the shield halves thus normally engage the shell in resilient interference such that a downward force must be applied to the distal portion of the shield 22 to completely close the shield. The shield member 22 acts as a lever and the pivot detents 58 and 60 act as a fulcrum to provide a lever type action. When the downward force is applied, the pivot detents force the engagement lips upwards against the engaged shell and provide positive engagement between the shield and the shell. This positive engagement assures an electrical connection between the shield and the shell. When fully closed, the shield 22 is in a loaded condition which assures that the shield 22 securely contacts the shell 18 at all times under all circumstances. The resulting clamping action also fixes the connector housing 27 against being easily shifted or moved relative to the shell or the shield.

Figure 5:
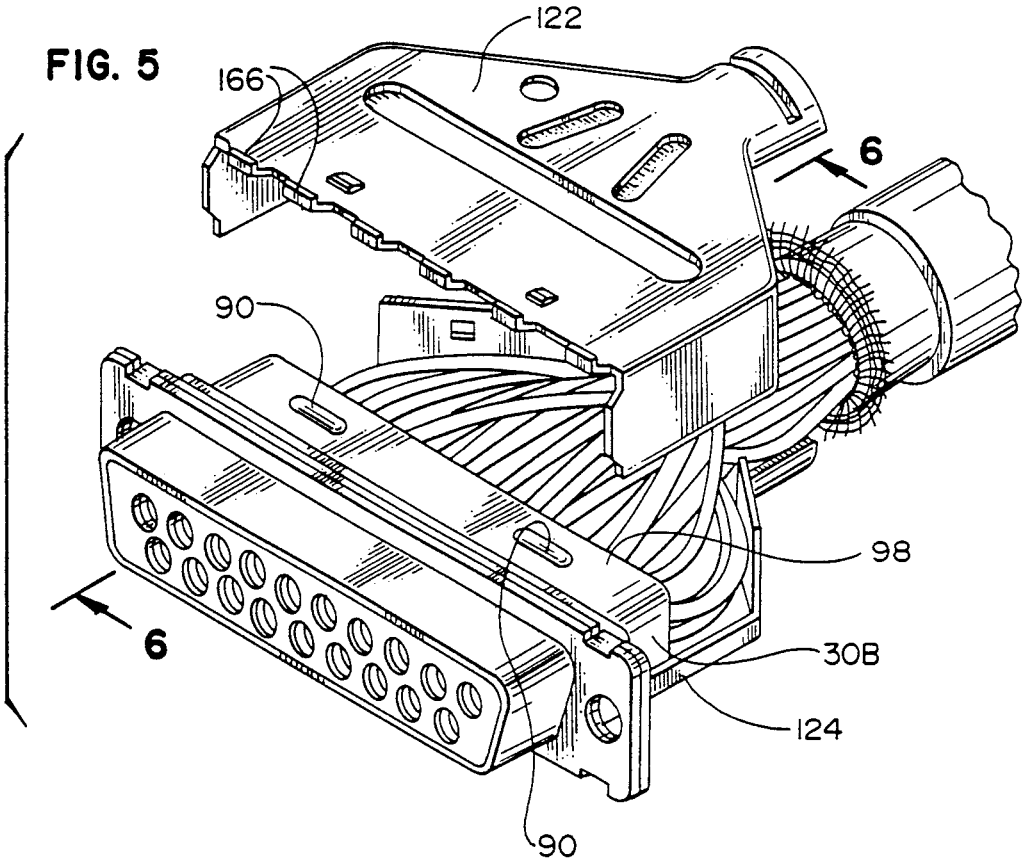
FIG. 5 is a perspective view of a second embodiment of a shielded connector assembly employing teachings of the invention, showing the connector in a partially assembled condition with only one shield member exploded therefrom.
Figure 6:
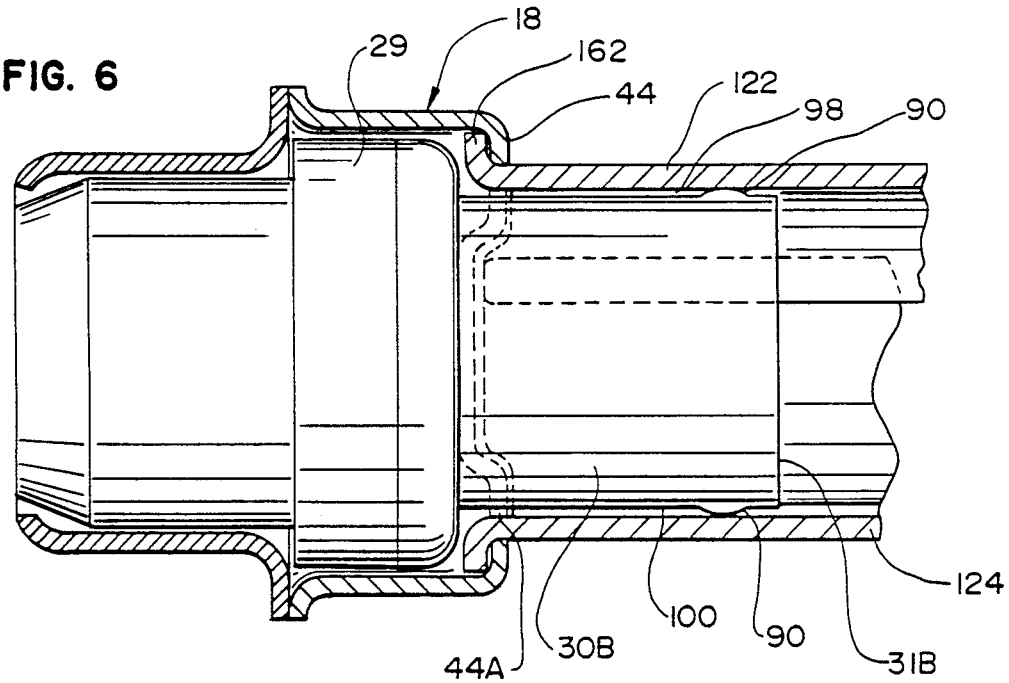
FIG. 6 is a partially schematic sectional view of the shielded connector taken along line 6—6 of FIG. 5.

A second embodiment of the shielded connector is shown in FIGS. 5 and 6. In this particular embodiment, the shielded connector is similar to the shielded connector in FIGS. 1–4 except that a fulcrum or pivot means 90 are located on the upper and lower surfaces 98 and 100 of the tail portion of the dielectric housing 30B. In addition, the shield members 122, 124 do not have the fulcrum detents 58, 60, 74 and 76 as shown in the shielded connectors in FIGS. 1–4. The fulcrum means 90 are outwardly protruding embossments which extend upwardly away from the upper and lower surfaces 98 and 100 of the dielectric housing. In this particular embodiment, the upper surface 98 has two embossments and the lower surface 100 has two additional embossments. Referring to FIG. 6, the embossments are located on the dielectric housing 30B between the flange 29 and the rear face 31B of the housing.

However, the number and location of the embossments can vary depending upon the particular connector design. For example, in a small electrical connector which only has nine electrical contacts 33, a single fulcrum embossment 90 may be located in the center of both the upper and lower surfaces 98 and 100 of the dielectric housing.

The operation of the shields 122 and 124 will be discussed by describing the operation of shield 122 since both shields operate in a similar manner. Referring to FIGS. 5 and 6, the lips 162 of the shield 122 are extended through the slot space within opening 44A, between the inner edge of the flange 44 and the tail portion of the dielectric housing 30B. In particular, the sectioned lips or tines may be hooked into the recesses 45 of the rear shell 18. This initial insertion typically occurs with the shield member tilted outward relative to the adjacent surface of tail portion 30B and the cable 38 to facilitate the insertion.

Thereafter, the shield member 122 is rotated inward, towards the cable 38, until the shield member 122 contacts the fulcrum means 90 on the dielectric housing 27. Further inward movement of the outer or distal end portion of the shield member 122 results in pivotal movement of the shield about the fulcrum established by the engagement of the shield with the fulcrum means 90 on the dielectric housing. Thereby, the further inward movement of the distal end portion causes concomitant outward movement of the lip portions beneath the edge of opening 44A.

The relevant dimensions, including the height of the insertion space, the effective thickness of the shield metal and the height of the protruding fulcrum means 90 is such that the fulcrum means 90 cause the tines 62 of the shield 122 to contact the shell 18 and oppose the downward rotation of the shield 122, preferably before the shield member reaches its fully seated or closed position.

The forward edge and cover tabs of the shield members thus normally engage the shell in resilient interference such that a downward force must be applied to the distal portion of the shield 122 to completely close the shield. The shield member 122 acts as a lever and the fulcrum means 90 act as a fulcrum to provide a lever type action. When the downward force is applied, the fulcrum means 90 force the engagement lips upwards against the engaged shell and provide positive engagement between the shield 122 and the shell 18. This positive engagement assures an electrical connection between the shield and the shell. When fully closed, the shield 122 is in a loaded condition which assures that the shield 122 securely contacts the shell 18 at all times under all circumstances. The resulting clamping action also fixes the connector housing 27 against being easily shifted or moved relative to the shell or the shield.

Figure 7:
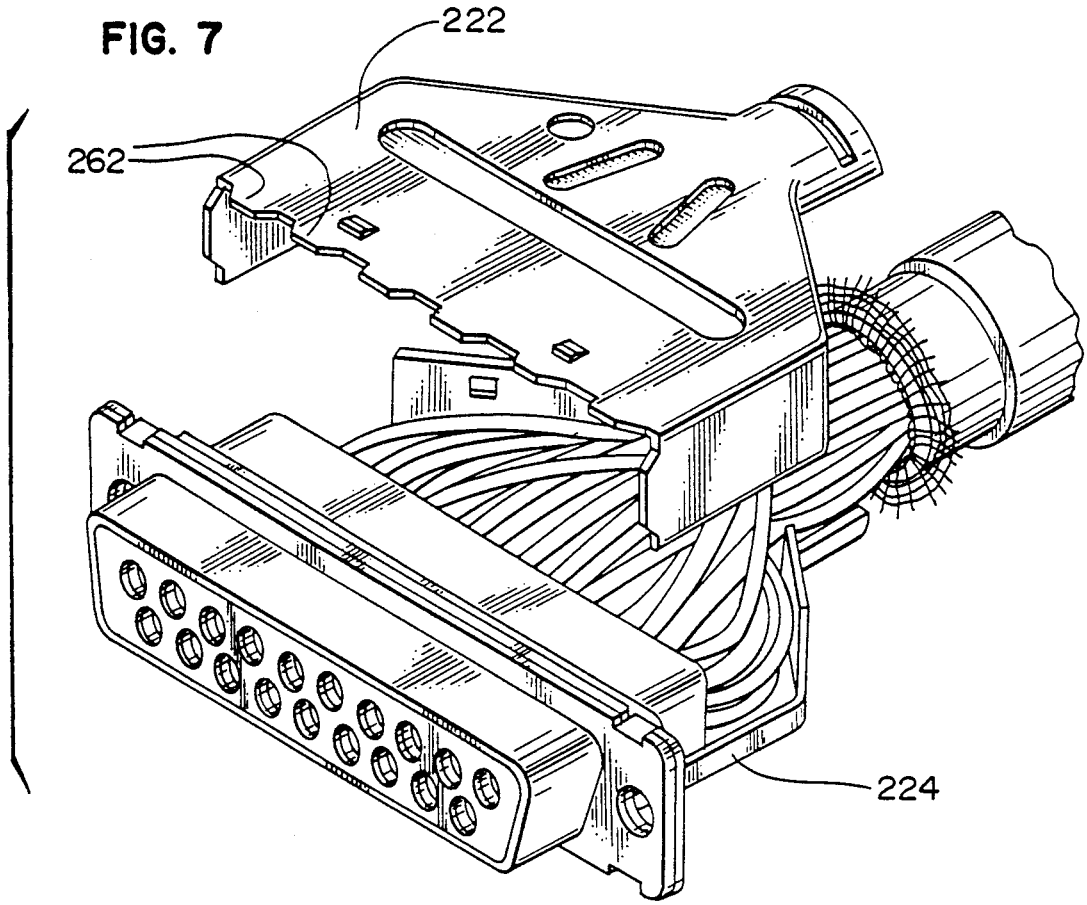
FIG. 7 is a perspective view of a third embodiment of a shielded connector assembly employing teachings of the invention, showing the connector in a partially assembled condition with only one shield member exploded therefrom.
Figure 8:
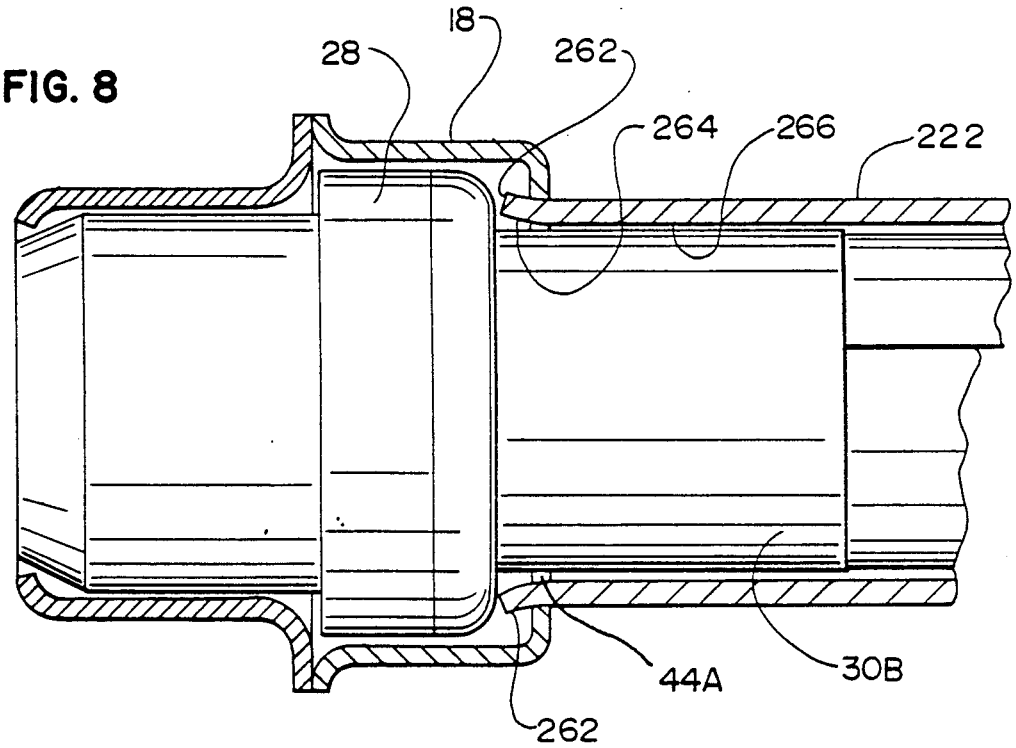
FIG. 8 is a partially schematic sectional view of the shielded connector taken along line 8—8 of FIG. 7.
Figure 9:
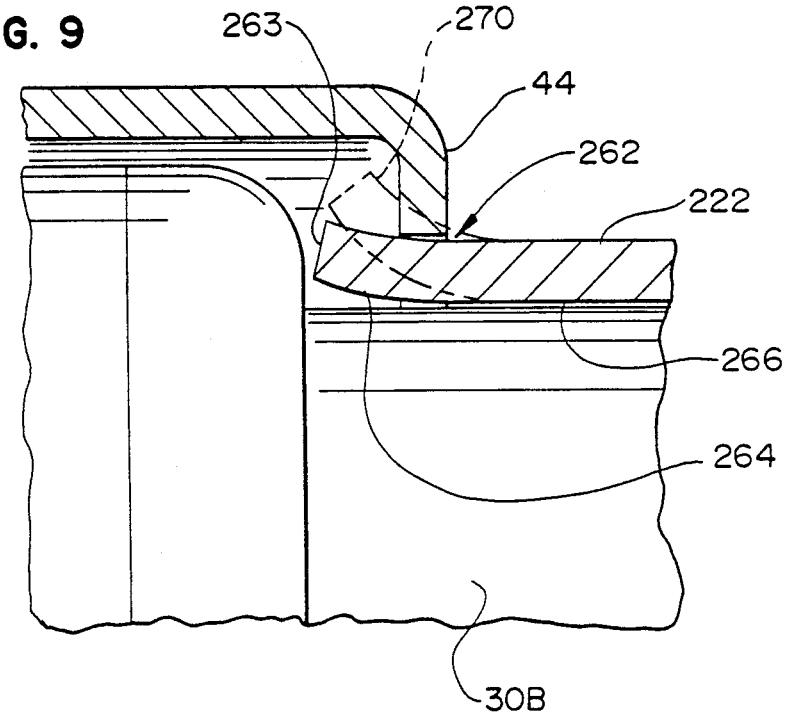
FIG. 9 is a fragmentary sectional view of the shielded connector in FIGS. 7 and 8.

A third embodiment of the shielded connector of this invention is shown in FIGS. 7, 8 and 9. In this particular embodiment, the shielded connector is similar to the shielded connectors in FIGS. 1–6 except for the configuration of the engagement lips or tines of the top and bottom shields 222 and 224. In addition, the shield members 222 and 224 do not have fulcrum detents 58, 60, 74 and 76 as shown in the shield members in FIGS. 1–4 and the dielectric housing does not have fulcrum embossments 90 as shown in FIGS. 5 and 6.

As shown in FIGS. 8 and 9, each shield is formed with an arcuate end portion 262 adjacent to or including the respective engagement lip or tine 263, e.g., by a large radius bend 264. The configuration of the end portions 262 differs from the flat shield and right angle bend lips 62 in FIG. 4 and the lips 162 in FIG. 6. In addition, a fulcrum portion 266 of the shield which is located slightly outward from the flanges 44 (within the bend 264) will act as a fulcrum. The arcuate portion 264 and the fulcrum portion 266 provide a vertical dimension between the upper surface of portion 262 which will engage the flange 44 and a lower surface outboard therefrom which will serve as the fulcrum, that is equal to or greater than the height of the insertion space 44B. As will be described below, this assures positive electrical contact between the shields 222 and 224 and the shell 18.

The operation of the shields 222 and 224 will be discussed by describing the operation of shield 222 since both shields operate in a similar manner. Referring to FIGS. 7 and 8, the lips 263 of the shield 222 are extended through the slot space within opening 44A, between the inner edge of the flange 44 and the tail portion of the dielectric housing 30B. In particular, the sectioned lips or tines may be inserted into the recesses 45 of the rear shell 18. This initial insertion typically occurs with the shield member tilted outward relative to the adjacent surface of tail portion 30B and the cable 38 to facilitate the insertion.

Thereafter, the shield member 222 is rotated inward, towards the cable 38, until the fulcrum portion 266 of the shield 222 contacts the dielectric housing 30B. Further inward movement of the outer or distal end portion of the shield member results in pivotal movement of the shield about the fulcrum established by the engagement of the shield with the dielectric housing. Thereby, the further inward movement of the distal end portion causes concomitant outward movement of the lip portions against the edge of flange 44 at slot 44B.

The relevant dimensions, including the height of the insertion space, the effective thickness of the shield metal and the displacement of shield end portions laterally of the general plane of the shield body 222 due to the bend 262 is such that the fulcrum portion causes the lips 263 of the shield 222 to contact the shell 18 during the downward rotation of the shield 222, preferably before the shield member reaches its fully seated or closed position.

The forward edge and lips of the shield members thus normally engage the shell in resilient interference such that a downward force must be applied to the distal portion of the shield 222 to completely close the shield. The shield member 222 acts as a lever and the fulcrum portion 266 acts as a fulcrum to provide a lever type action. When the downward force is applied, the fulcrum portion 266 forces the engagement lips upwards against the engaged shell and provides positive engagement between the shield and the shell. This downward force would also cause the lip 262 to bend or deflect from its normal or relaxed position 270 which is shown in dotted lines in FIG. 9. This positive engagement assures an electrical connection between the shield and the shell. When fully closed, the shield 222 is in a loaded condition which assures that the shield 222 securely contacts the shell 18 at all times under all circumstances. The resulting clamping action also fixes the connector housing 27 against being easily shifted or moved relative to the shell or the shield.

Referring to FIGS. 1 and 3, when both of the shields are assembled, the latching lugs 84 of shield 24 engage the latching apertures in shield 22 and hold the shields together until a ferrule 290 is crimped onto the annular cable engaging portions of the shields. The shielding 292 of the shielded multiconductor cable 38 is positioned over the cable exit portions 66 of the shields. The shielding 292 is secured to the shields by crimping the ferrule 290 over the shielding 292 and the cable exit portions 66 of the shields.

Figure 10:
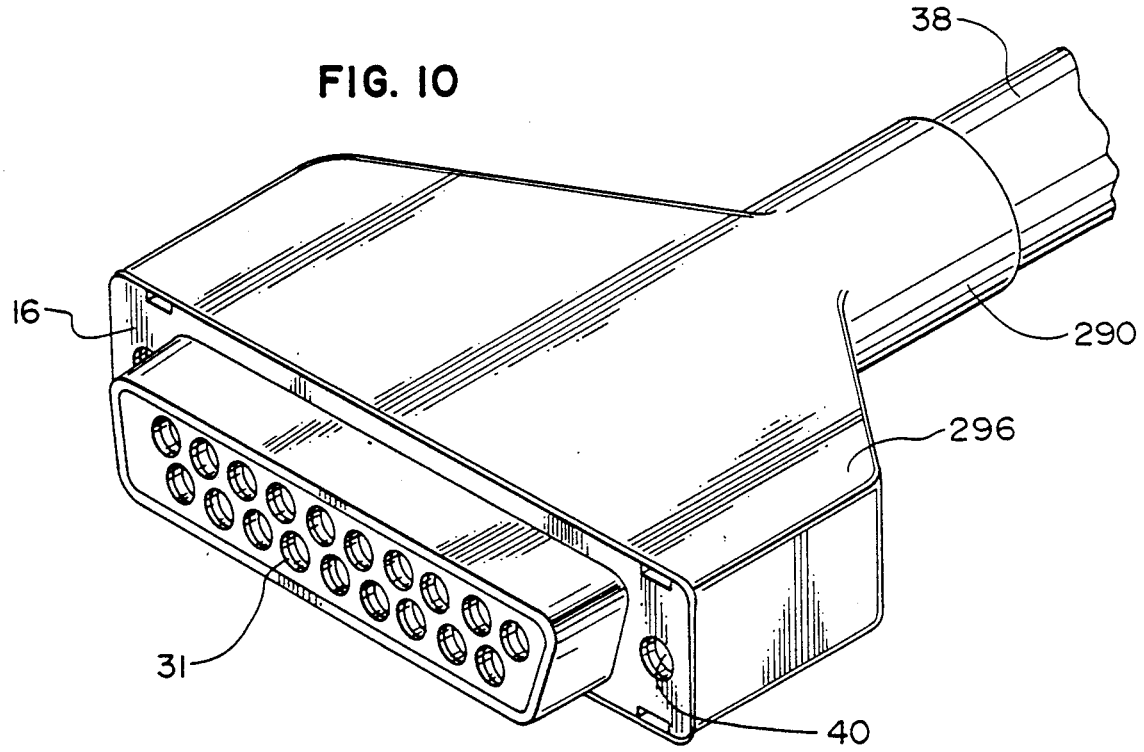
FIG. 10 is a perspective view of the shielded electrical connector after the overmolding operation.

The connector is now ready for the overmolding operation. As shown in FIG. 10, the shields are covered with the overmold material 296. The overmold material 296 provides an insulative barrier for the shields. The overmolding operation can exert pressure on the metal shields which is sufficient to crush the shields into the cavity formed by the shields. The pressure relief means 68 is provided to relieve the pressure of the overmolding operation.

The present invention assures a secure connection between the cover shields and the connector shell. The invention satisfies the need for an overmold shielded electrical connector which maintains a positive ground without the need for soldering during the manufacturing process, and meets the aforestated objects.

While specific embodiments of the invention have been shown and described, it will be understood that the invention is not limited to these embodiments. Those skilled in the art to which the invention pertains may make modifications and other embodiments employing the principals of this invention, particularly upon considering the foregoing teachings. Therefore, it is contemplated by the appended claims to cover any such modifications and other embodiments as incorporate the features of this invention within the true spirit and scope of the following claims.

What is claimed is:

1. A shielded electrical connector comprising an insulative housing, a conductive shell surrounding at least a portion of said housing, said insulative housing including a portion projecting from said conductive shell, a portion of said conductive shell overlying a proximal portion of said projecting portion of said insulative housing, and shield means including a contact portion to be positioned beneath said overlying portion of said shell and a body portion for encompassing said projecting portion of said insulative housing, said shield means designed to be assembled with said conductive shell and said insulative housing by engagement of said contact portion beneath a portion of said conductive shell and rotation of said body portion downward toward said projecting portion of said insulative housing, and said insulative housing and said shield means including portions which engage one another outboard of said contact portion of said shield means and thereby form a fulcrum whereby said contact portion of said shield means is rotated upward into contact with said overlying portion of said shell as said shield is assembled thereover by such rotational assembly motion.

2. The invention as in claim 1 wherein said portion to form a fulcrum includes an offset portion of said shield.

3. The invention as in claim 2 wherein said portion to form a fulcrum is defined by at least two inwardly protruding detents on said shield.

4. The invention as in claim 2 wherein said portion to form a fulcrum is defined by an arcuate portion of said shield.

5. The invention as in claim 2 wherein said portion to form a fulcrum is defined by at least one inwardly protruding detent on said shield.

6. The invention as in claim 5 wherein said detent is centrally located along the width of said shield.

7. The invention as in claim 1 wherein said portion to form a fulcrum is a portion of said insulative housing.

8. The invention as in claim 7 wherein said portion to form a fulcrum is at least two protruding embossments positioned on said insulative housing between said front mating face and rear conductor receiving face.

9. The invention as in claim 7 wherein said portion to form a fulcrum is at least one protruding embossment positioned on said insulative housing between said front mating face and said rear conductor receiving face.

10. The invention as in claim 9 wherein said protruding embossment is centrally located between said sidewalls of said connector.

11. A shield system for an electrical connector, said electrical connector having an insulative housing, a conductive shell surrounding at least a portion of said housing, said insulative housing including a portion projecting from said conductive shell, a portion of said conductive shell overlying a proximal portion of said projecting portion of said insulative housing, said shield system comprising a shield means including a contact portion to be positioned beneath said overlying portion of said shell and a body portion for encompassing said projecting portion of said insulative housing, said shield means designed to be assembled with said conductive shell and said insulative housing by engagement of said contact portion beneath a portion said conductive shell and rotation of said body portion downward toward said projecting portion of said insulative housing, and said insulative housing and said shield means including portions which engage one another outboard of said contact portion of said shield means and thereby form a fulcrum whereby said contact portion of said shield means is rotated upward into contact with said overlying portion of said shell as said shield is assembled thereover by such rotational assembly motion.

12. The invention as in claim 11 wherein said portion to form a fulcrum is defined by an arcuate portion of said shield.

13. The invention as in claim 11 wherein said portion to form a fulcrum includes an offset portion of said shield.

14. The invention as in claim 13 wherein said portion to form a fulcrum is defined by at least two inwardly protruding detents on said shield.

15. The invention as in claim 13 wherein said portion to form a fulcrum is defined by at least one inwardly protruding detent on said shield.

16. The invention as in claim 15 wherein said detent is centrally located along the width of said shield.

17. A shielded electrical connector comprising:

an insulative housing having a rear face, an upper surface, a lower surface, and a plurality of terminals mounted therein;

metal shell means covering a portion of the periphery of said housing forward of said rear face, said shell means having an aperture therethrough, and said insulative housing projecting rearward of said aperture toward said rear face;

a pair of shields enclosing the rear conductor receiving face of the conductor housing and a cavity extending rearward therefrom, said shields each having engagement means for engaging beneath a portion of said shell means proximate said aperture as said shields are rotated about said engagement means to form said cavity; and a fulcrum means outboard of said engagement means for pivoting said shield on said housing as said shields are so rotated such that said engagement means is urged outward and positively contacts said portion of said shell means to assure an electrical connection between said shields and said shell means.

18. The invention as in claim 17 wherein said fulcrum means includes an offset portion of said shield.

19. The invention as in claim 18 wherein said fulcrum means is defined by at least two inwardly protruding detents on said shield.

20. The invention as in claim 18 wherein said fulcrum means is defined by an arcuate portion of said shield.

21. The invention as in claim 18 wherein said fulcrum means is defined by at least one inwardly protruding detent on said shield.

22. The invention as in claim 21 wherein said detent is centrally located along the width of said shield.

23. The invention as in claim 17 wherein said fulcrum means is a portion of said insulative housing.

24. The invention as in claim 23 wherein said fulcrum means is at least two protruding embossments positioned on said insulative housing between said front mating face and rear conductor receiving face.

25. The invention as in claim 23 wherein said fulcrum means is at least one protruding embossment positioned on said insulative housing between said front mating face and said rear conductor receiving face.

26. The invention as in claim 25 wherein said protruding embossment is centrally located between said sidewalls of said connector.

27. A shield system for an electrical connector, said electrical connector having an insulative housing including a rear face, and a plurality of terminals mounted therein and a metal shell means covering a portion of the periphery of said housing forward of said rear face, said shell means having an aperture therethrough, and said insulative housing projecting rearward of said aperture toward said rear face, said shield system comprising a pair of shields enclosing the rear conductor receiving face of the conductor housing and a cavity extending rearward therefrom, said shields each having engagement means for engaging said shell means proximate said aperture as said shields are rotated about said engagement means to form said cavity and a fulcrum means outboard of said engagement means for pivoting said shield on said housing as said shields are so rotated such that said engagement means is urged outward and positively contacts said portion of said shell means to assure an electrical connection between said shields and said shell means.

28. The invention as in claim 27 wherein said fulcrum means is defined by an arcuate portion of said shield.

29. The invention as in claim 27 wherein said fulcrum means includes an offset portion of said shield.

30. The invention as in claim 29 wherein said fulcrum means is defined by at least two inwardly protruding detents on said shield.

31. The invention as in claim 29 wherein said fulcrum means is defined by at least one inwardly protruding detent on said shield.

32. The invention as in claim 31 wherein said detent is centrally located along the width of said shield.

* * * * *